United States Patent [19]

Savigny

[11] Patent Number: 4,715,167

[45] Date of Patent: Dec. 29, 1987

[54] BAGGER MACHINE

[75] Inventor: James G. Savigny, Lockport, N.Y.

[73] Assignee: Ag-Pak, Inc., Gasport, N.Y.

[21] Appl. No.: 894,616

[22] Filed: Aug. 8, 1986

[51] Int. Cl.[4] ..... B65B 43/28

[52] U.S. Cl. ..... 53/572; 53/573; 53/386

[58] Field of Search ..... 53/572, 573, 571, 570, 53/386, 384, 468, 459; 414/330

[56] References Cited

U.S. PATENT DOCUMENTS

| | | | |
|---|---|---|---|
| 3,050,918 | 8/1962 | Helm et al. | 53/386 |
| 3,731,454 | 5/1973 | Crabb | 53/55 |
| 3,789,573 | 2/1974 | Crabb | 53/55 |
| 4,172,349 | 10/1979 | Lipes | 53/459 |
| 4,245,944 | 1/1981 | Van Ginkel et al. | 414/330 |
| 4,291,517 | 9/1981 | Lipes | 53/468 |
| 4,541,228 | 9/1985 | Petersen | 53/572 |

FOREIGN PATENT DOCUMENTS

| | | | |
|---|---|---|---|
| 1308141 | 2/1973 | United Kingdom | 53/573 |

*Primary Examiner*—James F. Coan

*Attorney, Agent, or Firm*—Joseph P. Gastel

[57] ABSTRACT

A bagger machine having a frame, a wicket bar mounted on the frame, a rear clamp cylinder for pressing tabs at the upper edges of the rear sides of a ream of bags against the wicket bar, a carriage mounted for sliding movement on the frame, a suction head on the carriage for attracting the front side of the outermost bag of a ream, a bag opening cylinder for moving the carriage while the suction head engages the front side of the bag to open the bag, a bag clamping cylinder on the carriage for clamping the upper edge of the front of a bag against the suction head, a bag push cylinder for moving a filled bag in a direction away from the wicket bar after it has been filled, a control for momentarily causing the rear clamp cylinder to release the tab of the bag being moved while the bag is moving away from the wicket bar, a conveyor underlying the filled bag to support it after its tab has been released and as it is moving away from the wicket bar, a control for causing the front clamp cylinder to release the upper edge of the bag, and a control for causing the carriage to reverse itself and place the bag holding cylinder and the bag push cylinder in condition for repeating the above-described movements.

25 Claims, 35 Drawing Figures

Fig. 1A.
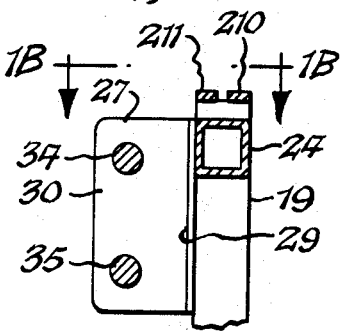
Fig. 2A.
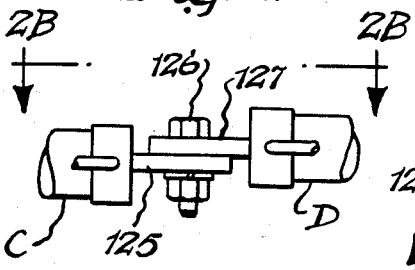
Fig. 2C.
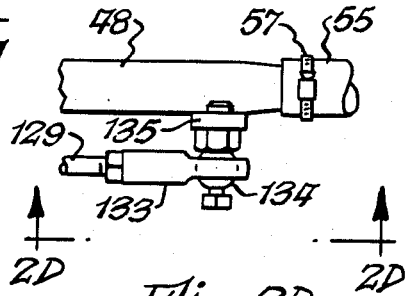
Fig. 2B.
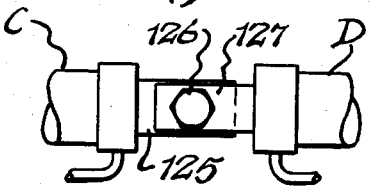
Fig. 2D.
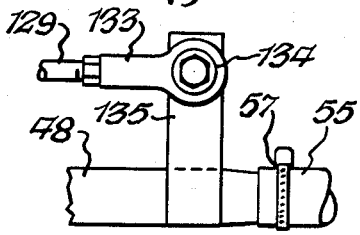
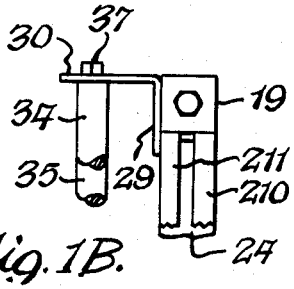
Fig. 1B.
Fig. 1G.
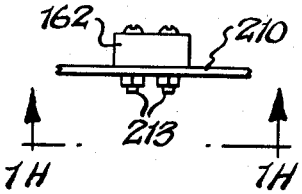
Fig. 3A.
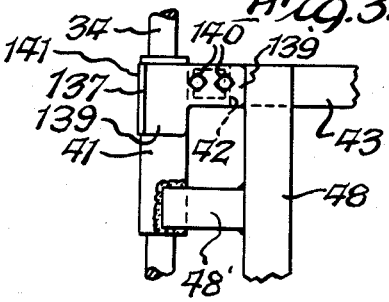
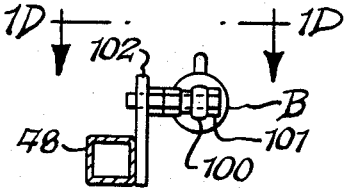
Fig 1C.
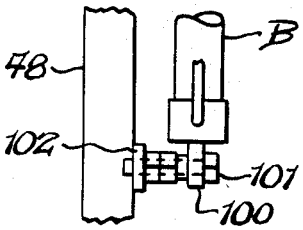
Fig. 1D.
Fig. 1H.
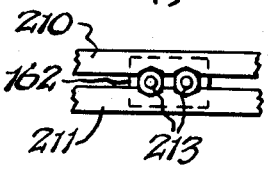
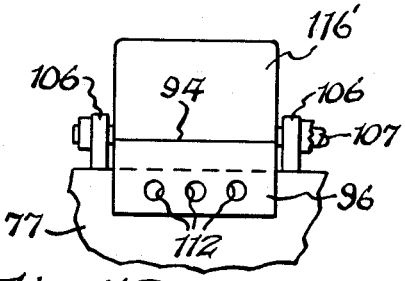
Fig. 4B.
Fig. 1E.
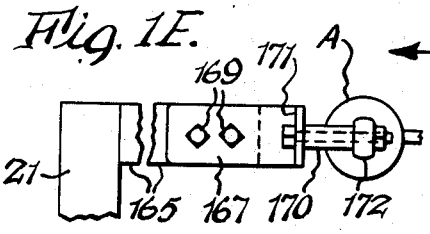
Fig. 1F.
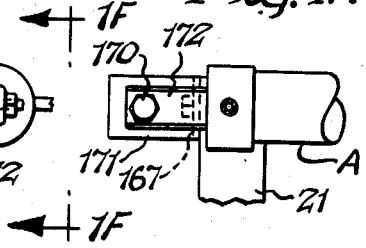
Fig. 5A.
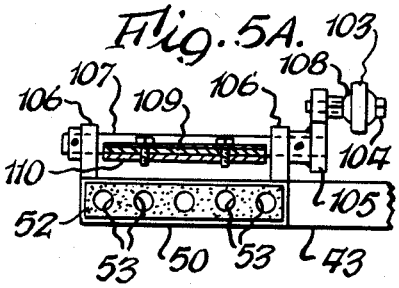

Fig. 8.
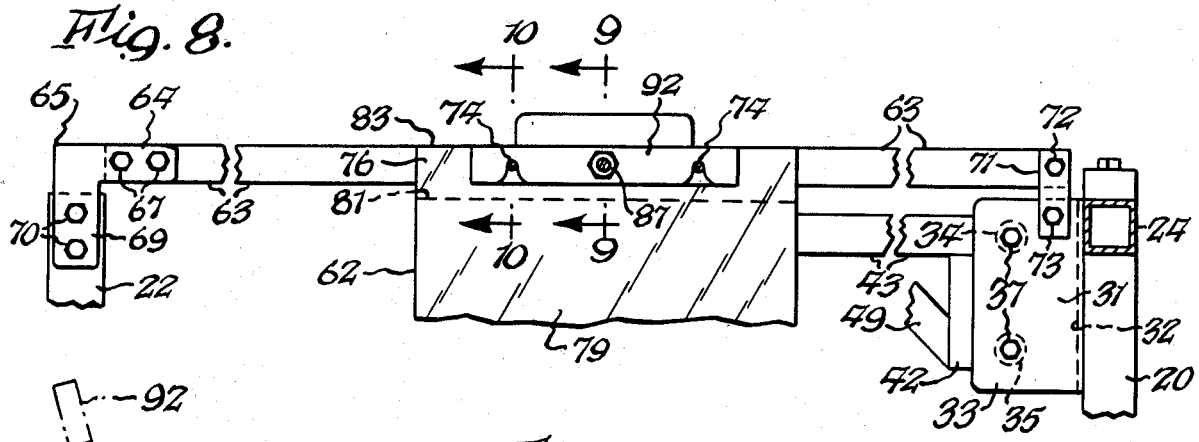
Fig. 9.
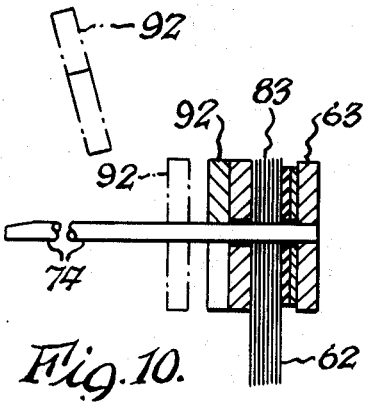
Fig. 10.
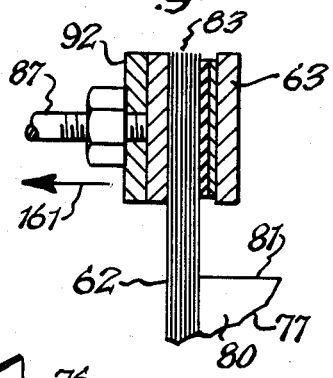
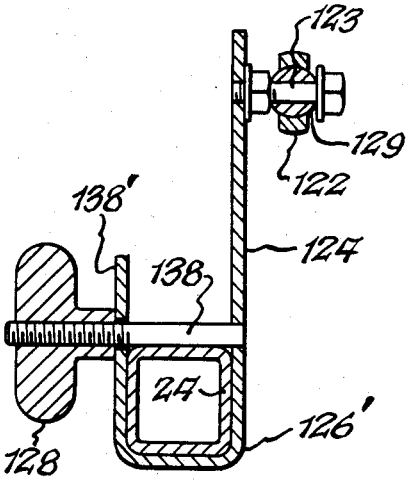
Fig. 11.
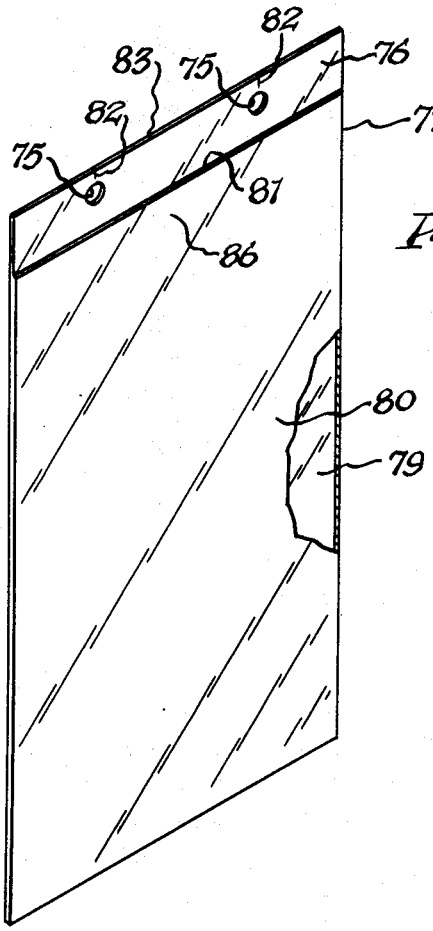
Fig. 12.
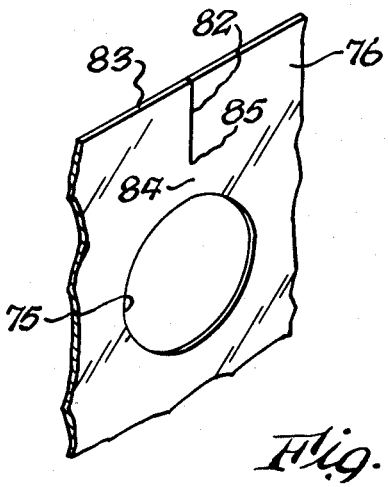
Fig. 13.

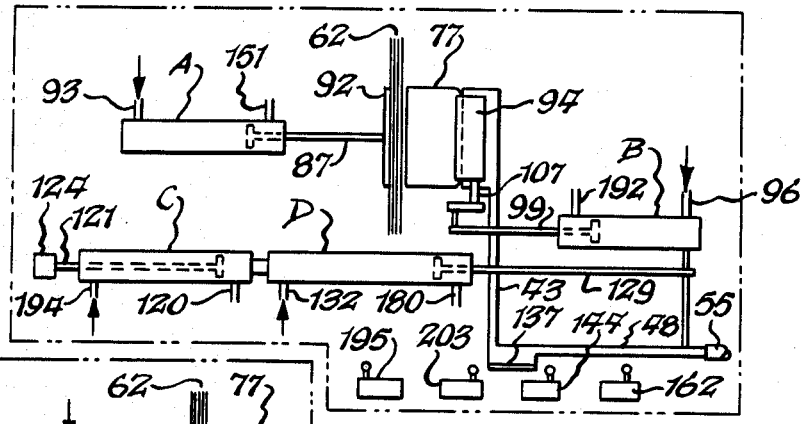
Fig. 14.
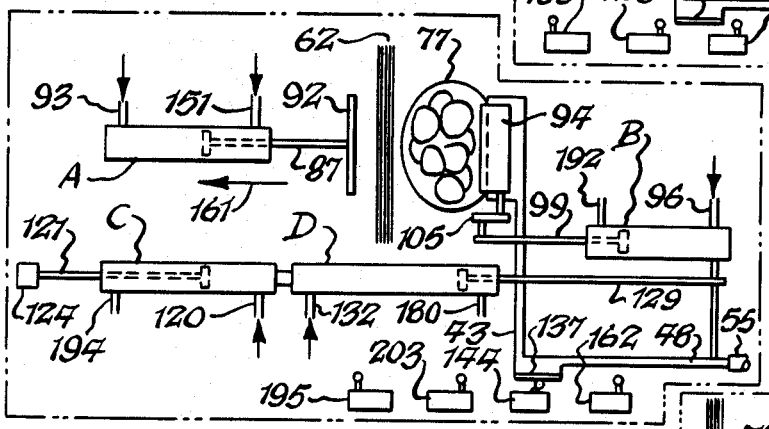
Fig. 15.
Fig. 16.
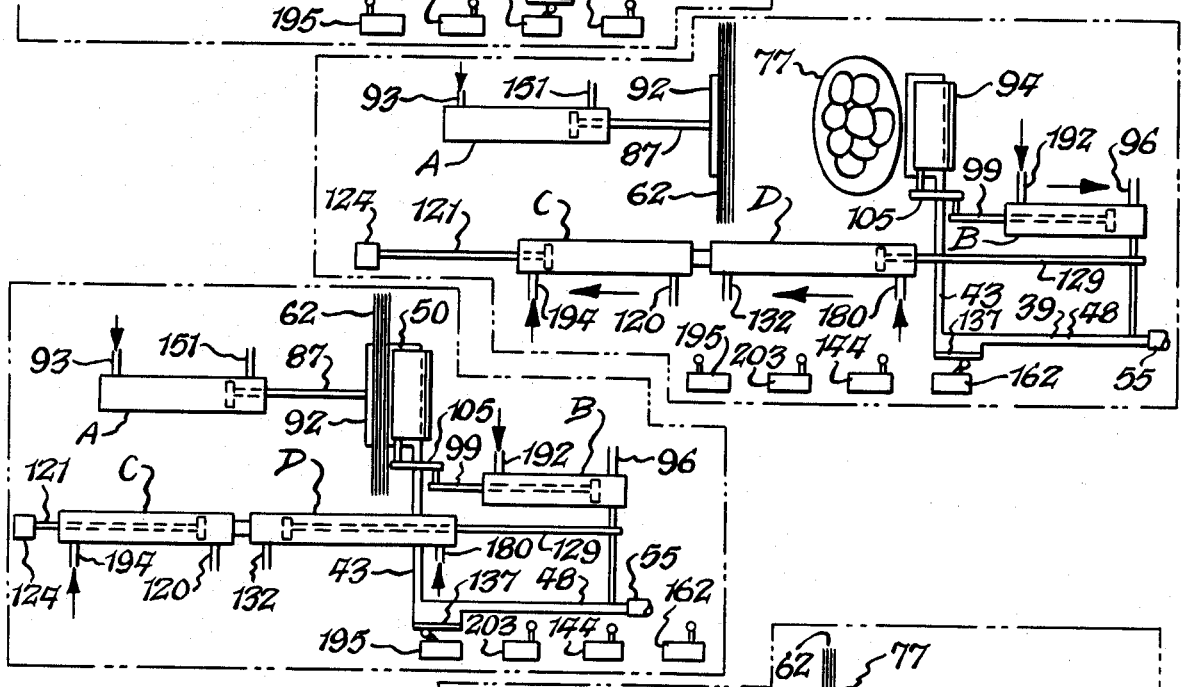
Fig. 17.
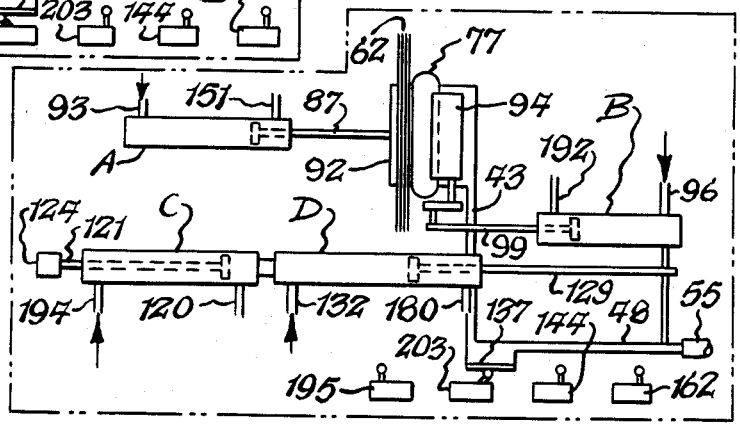
Fig. 18.

MAIN AIR SUPPLY LINE
BAG OPENING CYLINDER
136
FRONT CLAMP CYLINDER
95
REAR CLAMP CYLINDER
89
BAG PUSH CYLINDER
TIMER
174
175
181
179
131
195
200
199
202
178
132
177
129
D
90
182
180
189
205
187
184
186
183
203
209
97
206
204
207
99
191
B
96
114
113
118'
115
115'
192
194
116
120'
152
117
150
144
190
119
145
149
118
161
87
93
A
147
151
120
162
163
121
130
124
C
193
91

BAGGER MACHINE

BACKGROUND OF THE INVENTION

The present invention relates to an improved automatic bagger machine of the type in which produce or other items is packed.

By way of background, prior types of bagger machines were relatively complex, as can be seen from prior art U.S. Pat. Nos. 3,731,454 and 3,789,572 and copending U.S. application Ser. No. 740,401, filed June 3, 1985, now U.S. Pat. No. 4,644,735. The relatively complex structure detracted from relatively high speed operation and further increased its cost.

SUMMARY OF THE INVENTION

It is accordingly one object of the present invention to provide an improved bagger machine which is relatively simple when compared to prior art machines.

Another object of the present invention is to provide a bagger machine which is capable of relatively high speed operation in view of its simplicity.

A further object of the present invention is to provide an improved bagger machine which opens bags, holds them open, and releases them in a unique manner.

A still further object of the present invention is to provide an improved bagger machine which releases one side of an opened bag in a positive and unique manner while the other side is being held and moved away from the position in which the bag was filled.

Still another object of the present invention is to provide an improved bagger machine in which a bag is pulled open by a suction head and is clamped by a clamp member which exerts a clamping force on the portion of a bag between it and the suction head.

Yet another object of the present invention is to provide an improved bagger machine having uniquely integrated mechanism and pneumatic controls for providing high speed operation. Other objects and attendant advantages of the present invention will readily be perceived hereafter.

The present invention relates to a bagger having a bag clamping mechanism for the upper edge of the front side of a bag also having a rear side comprising a suction head, means for moving said suction head into engagement with said front side of said bag and for moving said suction head in the opposite direction to move said front side of said bag away from said rear side of said bag, and clamp means movable in a direction toward said suction head for applying a clamping force to the opposite side of said front side of said bag from said suction head.

The present invention also relates to a bag mounting and releasing structure for a bagger comprising a frame, a wicket bar on said frame having a rear face and a front face for mounting a ream of bags each having a front side and a rear side and a tab located at the upper edge portion of said rear side and holes in said tab, a plurality of prongs extending outwardly from said rear face of said wicket bar for insertion into holes in said tabs with said front sides of said bags facing said rear side of said wicket bar, motor means, a clamp plate coupled to said motor means, first control means coupled to said motor means for causing said motor means to cause said clamp plate to constantly clamp said tabs of said ream of bags against said rear face of said wicket bar, and second control means coupled to said motor means to selectively cause said motor means to cause said clamp plate to momentarily move away from said rear face of said wicket bar to release pressure on said tabs.

The present invention also relates to a bagger comprising a frame, a wicket bar on said frame for mounting a ream of bags each having a front side and a rear side and a tab at the upper edge portion of the rear side of the bag with the front sides of said bags being located below said wicket bar, first means for clamping said tabs of said ream against said wicket bar, a carriage on said frame, a suction head on said carriage, second means for moving said carriage toward said wicket bar to cause said suction head to engage the upper edge portion of the front side of an outermost bag of said ream and for moving said suction head away from said wicket bar to move said front side of said bag so engaged away from the rear side of said bag so engaged to thereby open the mouth of said bag, second clamp means, means mounting said second clamp means on said carriage, and third means for causing said second clamp means to clamp said upper edge portion of each bag after said front side has moved away from said rear side.

The present invention also relates to a bagger comprising a frame, a wicket bar on said frame for mounting a bag having a front side and a rear side and a tab at the upper edge portion of the rear side of the bag with the front side of said bag being located below said wicket bar, first means including first control means and first clamp means for clamping said tab of said bag against said wicket bar, a carriage on said frame, a suction head on said carriage, second means including second control means for moving said carriage toward said wicket bar to cause said suction head to engage the upper edge portion of the front side of said bag and for moving said suction head away from said wicket bar to move said front side of said bag which is held against said suction head by suction away from the rear side of said bag which is clamped to said wicket bar to thereby open the mouth of said bag, second clamp means, means mounting said second clamp means on said carriage, third means including third control means for causing said second clamp means to apply a clamping force to said upper edge portion of each bag after said front side has moved away from said rear side and for causing said front side to thereafter remain stationary, and fourth means including fourth control means for moving said front side of said bag while still clamped by said second clamp means further away from said wicket bar.

The present invention also relates to a bagger comprising a frame, a wicket bar having a front side and a rear side on said frame for mounting a ream of bags each having a front side and a rear side with said front sides of said bags facing said rear side of said wicket bar, said bags also having tabs at the upper ends of said rear sides, a rear clamp cylinder including a rear clamp piston rod, a rear clamp plate on said rear clamp piston rod for movement toward said wicket bar with said rear clamp piston rod to press against said tabs of said bags, a carriage, means mounting said carriage on said frame for movement toward and away from said wicket bar, a suction head on said carriage, means for creating a suction in said suction head, a bag opening cylinder mounted between said frame and said carriage for moving said carriage and said suction head thereon toward said ream on said wicket bar to engage the front side of the outermost bag on said ream and apply suction thereto and for moving said suction head away from said ream to pull the front side of said outermost bag away from the rear side thereof which is held on said wicket bar, a front clamp cylinder, means mounting said front clamp cylinder on said carriage, a front clamp piston rod on said front clamp cylinder, a clamp member on said carriage coupled to said front clamp piston rod, means mounting said clamp member for movement toward and away from said suction head to selectively clamp said upper edge portion of said front side of said bag after it has been moved away from said wicket bar and to selectively release said upper edge portion of said front side of said bag, and a bag push cylinder effectively mounted between said frame and said carriage for pushing said outermost bag away from said wicket bar while said front upper edge portion is effectively clamped between said suction head and said clamp member.

The various aspects of the present invention will be more fully understood when the following portions of the specification are read in conjunction with the accompanying drawings wherein:

BRIEF DESCRIPTION OF THE DRAWINGS

FIG. 1A is a fragmentary cross sectional view taken substantially along line 1A—1A of FIG. 1;

FIG. 1B is a fragmentary plan view taken substantially in the direction of arrows 1B—1B of FIG. 1A;

FIG. 1C is a fragmentary cross sectional view taken substantially along line 1C—1C of FIG. 1;

FIG. 1D is a fragmentary plan view taken substantially along line 1D—1D of FIG. 1C;

FIG. 1E is a fragmentary view taken substantially in the direction of arrows 1E—1E of FIG. 1;

FIG. 1F is a fragmentary view taken substantially in the direction of arrows 1F—1F of FIG. 1E;

FIG. 1G is a fragmentary view taken in the direction of arrows 1G—1G of FIG. 1;

FIG. 1H is a fragmentary view taken in the direction of arrows 1H—1H of FIG. 1G;

FIG. 2A is a fragmentary view taken substantially in the direction of arrows 2A—2A of FIG. 2;

FIG. 2B is a fragmentary view taken substantially in the direction of arrows 2B—2B of FIG. 2A;

FIG. 2C is a fragmentary plan view taken substantially in the direction of arrows 2C—2C of FIG. 2;

FIG. 2D is a fragmentary view taken substantially in the direction of arrows 2D—2D of FIG. 2C;

FIG. 3A is a fragmentary view taken substantially in the direction of arrows, 3A—3A of FIG. 3;

FIG. 4B is a view taken substantially in the direction of arrows 4B—4B of FIG. 4;

FIG. 5A is a fragmentary view taken substantially in the direction of arrows 5A—5A of FIG. 5;

FIG. 8 is a fragmentary cross sectional view taken substantially along line 8—8 of FIG. 1 and showing the bag mounting wicket bar and related structure;

FIG. 9 is a fragmentary cross sectional view taken substantially along line 9—9 of FIG. 8 and showing the upper edges of the rear sides of plastic bags clamped on the wicket bar;

FIG. 10 is a fragmentary cross sectional view taken substantially along line 10—10 of FIG. 8 and showing the upper rear edges of the bags mounted on a wicket bar prong and clamped by the bag clamping structure and showing in dotted line how the bag clamp moves away from the bags;

FIG. 11 is a fragmentary cross sectional view taken substantially along line 11—11 of FIG. 2 and showing structure for adjusting the amount a bag is to be opened;

FIG. 12 is a perspective view of the type of bag which is mounted on the machine;

FIG. 13 is a fragmentary enlarged portion of FIG. 12 showing the hole structure in the bag;

FIG. 14 is a fragmentary schematic view of the various operating portions of the bagger in the position wherein the bag is being held open by its front and rear edges ready to receive material;

FIG. 15 is a fragmentary schematic view showing the positions of the various operating parts while the rear edge of the bag is being released and the bag is being carried to the right;

FIG. 16 is a fragmentary schematic view showing the positions of the various operating parts after the bag has been carried more to the right and the front edge of the bag has been released and the bag clamping mechanism is ready to start moving to the left;

FIG. 17 is a fragmentary schematic view showing the positions of the various operating parts after the front clamp mechanism has moved fully to the left and has reached its position for pulling the front edge of a bag open;

FIG. 18 is a fragmentary schematic view showing the positions of the various operating parts as the bag is being pulled to an open position and immediately prior to the time that it reaches the bag loading position of FIG. 14.

DESCRIPTION OF THE PREFERRED EMBODIMENTS

Figure 1:
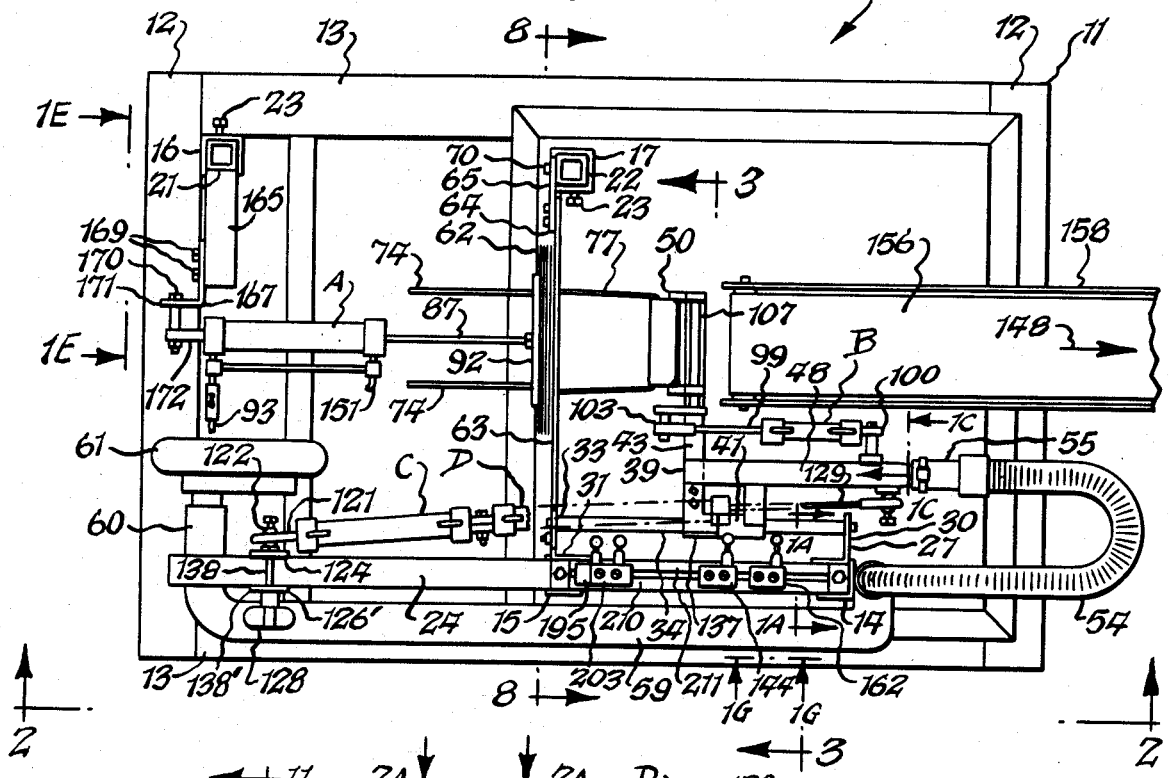
FIG. 1 is a plan view of the bagger of the present invention.

The bagger 10 includes a rectangular base 11 consisting of end channels 12 and side channels 13. A plurality of telescopic legs have lower portions 14, 15, 16 and 17 extend upwardly from base 11 and have upper telescoping portions 19, 20, 21 and 22, respectively, which are held in adjusted positions by set screws 23. The upper portions of the legs can move into and out of the lower portions to adjust the height of the various elements of structure carried by the legs.

A tubular member 24 (FIGS. 1, 2 and 3) has an end portion 25 attached to the top of leg portion 19, as by welding, and it has a central portion 26 attached to the top of leg portion 20, as by welding, and the portion of tubular member 24 to the left of leg portion 20 (FIG. 2) is cantilevered. A first angle 27 (FIGS. 1 and 1A) has a leg 29 secured as by welding to upper leg portion 19, and it has a leg 30 extending as shown. An angle 31 (FIGS. 1 and 3) has a leg 32 secured to upper leg portion 20 as by welding and it has a leg 33 extending as shown. Angles 27 and 31 are oriented in mirror image relationship. A pair of parallel guide rods 34 and 35 (FIGS. 1, 2 and 3) have their opposite ends secured between angle legs 30 and 33. The securing is effected by four screws, such as 37 (FIG. 1B), which extend through legs 30 and 33. A screw 37 is received in each end of rods 34 and 35.

Figure 2:
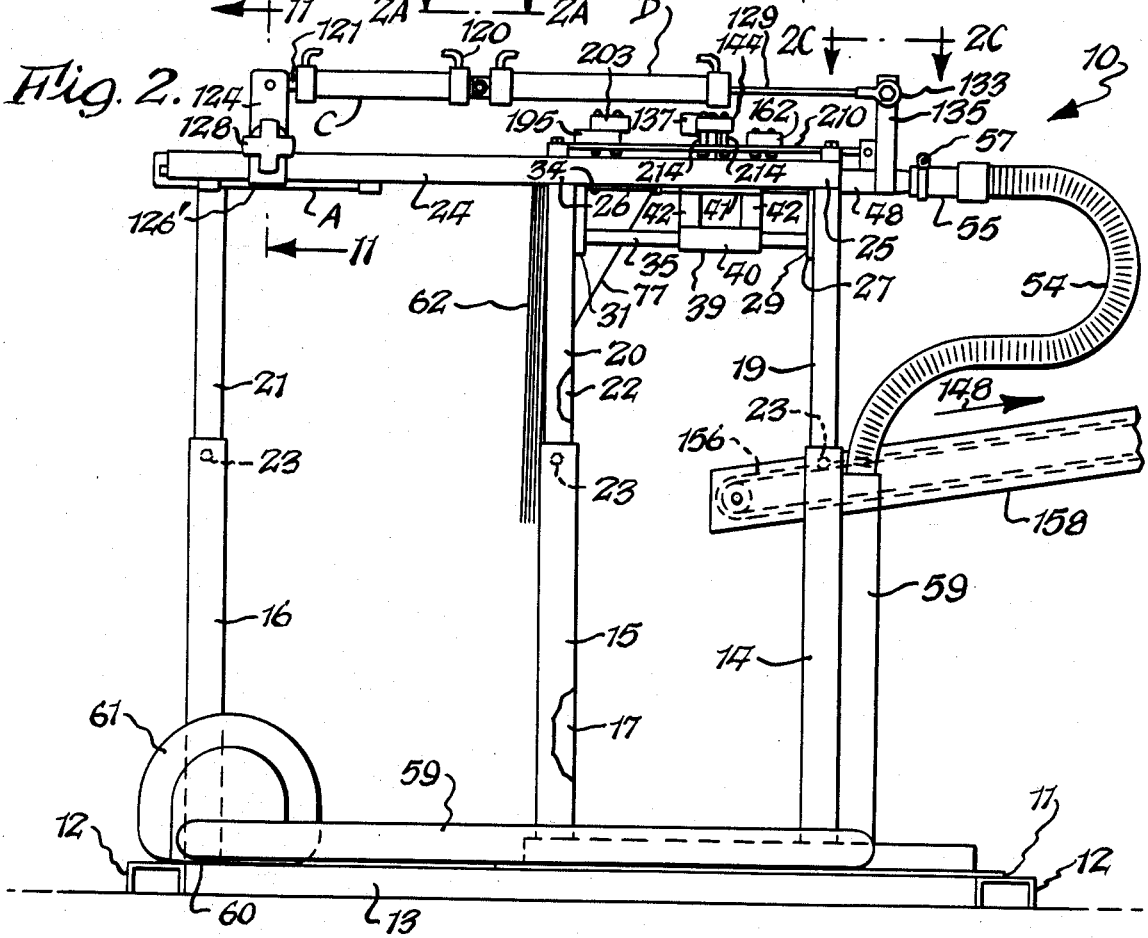
FIG. 2 is a side elevational view of the bagger of FIG. 1 taken substantially in the direction of arrows 2—2.
Figure 3:
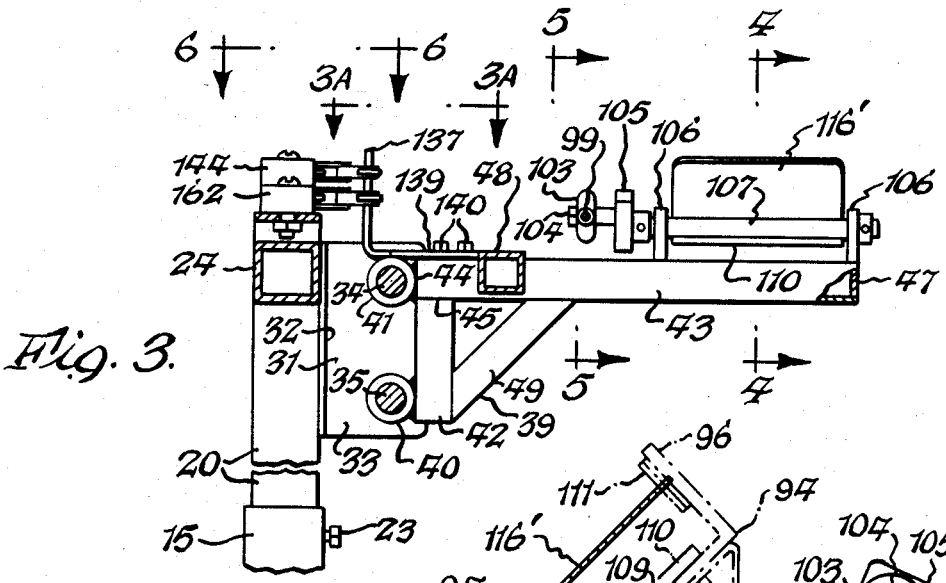
FIG. 3 is a fragmentary cross sectional view taken substantially along line 3—3 of FIG. 1 and showing particularly the bag opening carriage mounted on its guides and the switch plate in relationship to certain pneumatic switches.

A carriage 39 (FIGS. 1, 2 and 3) includes a lower sleeve bearing 40 (FIGS. 2 and 3) slidably mounted on lower rod 35 and an upper sleeve bearing 41 slidably mounted on upper rod 34. Sleeve bearings 40 and 41 are welded to vertical members 42 (FIGS. 2 and 3). A horizontal tubular member 43 (FIGS. 1 and 3) extends in a direction perpendicular to hollow member 24 and has its end welded to sleeve 41 at 44, and the upper end of member 42 is welded to member 43 at 45. Hollow tubular member 43 is sealed at its end 47 and at its end at 44. A diagonal brace 49 (FIG. 3) has its lower end welded to member 42 and its upper end welded to the underside of tubular member 43. A suction head 50 is mounted at the outer end of tubular member 43 (FIGS. 1, 4, 5 and 5A) and is in communication therewith through a plurality of openings 51 therebetween. A strip of rubber-like material 52 (FIGS. 5 and 5A) is laid across the face of suction head 50 and a plurality of holes 53 (FIGS. 4A and 5A) vent suction head 50 to the atmosphere by extending through suction head 50 and rubber-like member 52 thereon.

A tubular member 48 (FIGS. 1, 2, 3 and 3A) has one end in communication with hollow tubular member 43. A brace plate 48' is welded between member 43 and bearing 41. A flexible hose 54 (FIGS. 1 and 2) has its end 55 mounted in fluid-tight relationship with the other end of tubular member 48 by hose clamp 57. The opposite end of flexible hose 54 is secured in fluid-tight relationship to conduit 59 which has its opposite end 60 secured in fluid-tight relationship to vacuum pump 61 to thus create a suction at holes 53. During operation, vacuum pump 61 runs constantly to always create a suction at holes 53.

A ream 62 of bags is mounted on wicket bar 63 (FIGS. 1 and 8). One end of wicket bar 63 is secured to the horizontal leg 64 of angle 65 by bolts 67. The vertical leg 69 of angle 65 is secured to upper leg portion 22 by screws 70. The opposite end of wicket bar 63 is bolted to bracket 71 at 72, and bracket 71 has its lower portion bolted at 73 to angle leg 33 of angle 31. A pair of prongs 74 extend outwardly from wicket bar 63, and the ream 62 is mounted thereon. In this respect, prongs 74 extend through spaced holes 75 (FIGS. 12 and 13) in tab 76 on the upper edge of the rear side 79 of each bag 77. The rear side 79 of each bag 77 is longer than front side 80, and tab 76 is an integral extension of rear side 79 which extends beyond front side 80. The front side 80 terminates at top edge 81, which is below wicket bar 63. Slits 82 extend downwardly from upper edge 83 of tab 76 toward holes 75 but stop short thereof, thus leaving an unslitted portion 84 between the top of each hole 75 and the lowermost end 85 of each slit 82. Bag 77 is of the polyethylene type, but it is contemplated that with suitable modification, mesh bags also can be used on the machine.

Summarizing in advance, a pneumatic control circuit which includes a plurality of pneumatic cylinders and associated structure perform the following functions. It causes the short side 80 of the outermost bag to be pulled away from the rear side thereof while the latter is being held on the wicket bar; it causes the upper edge of the front side of the bag to be clamped while the rear side remains clamped to the wicket bar; it causes the bag to be held open while it is being filled it starts moving the front side of the bag further away from the wicket bar after it is filled; it causes the rear edge of the bag to be released from the wicket bar after the front side starts moving away from the wicket bar and while the front side is still held; it causes the bag thus released to move onto a conveyor for being conveyed to a tying machine (not shown); it causes the front side to be released after the filled bag is supported on the conveyor; and it thereafter repeats the operation.

Figure 19:
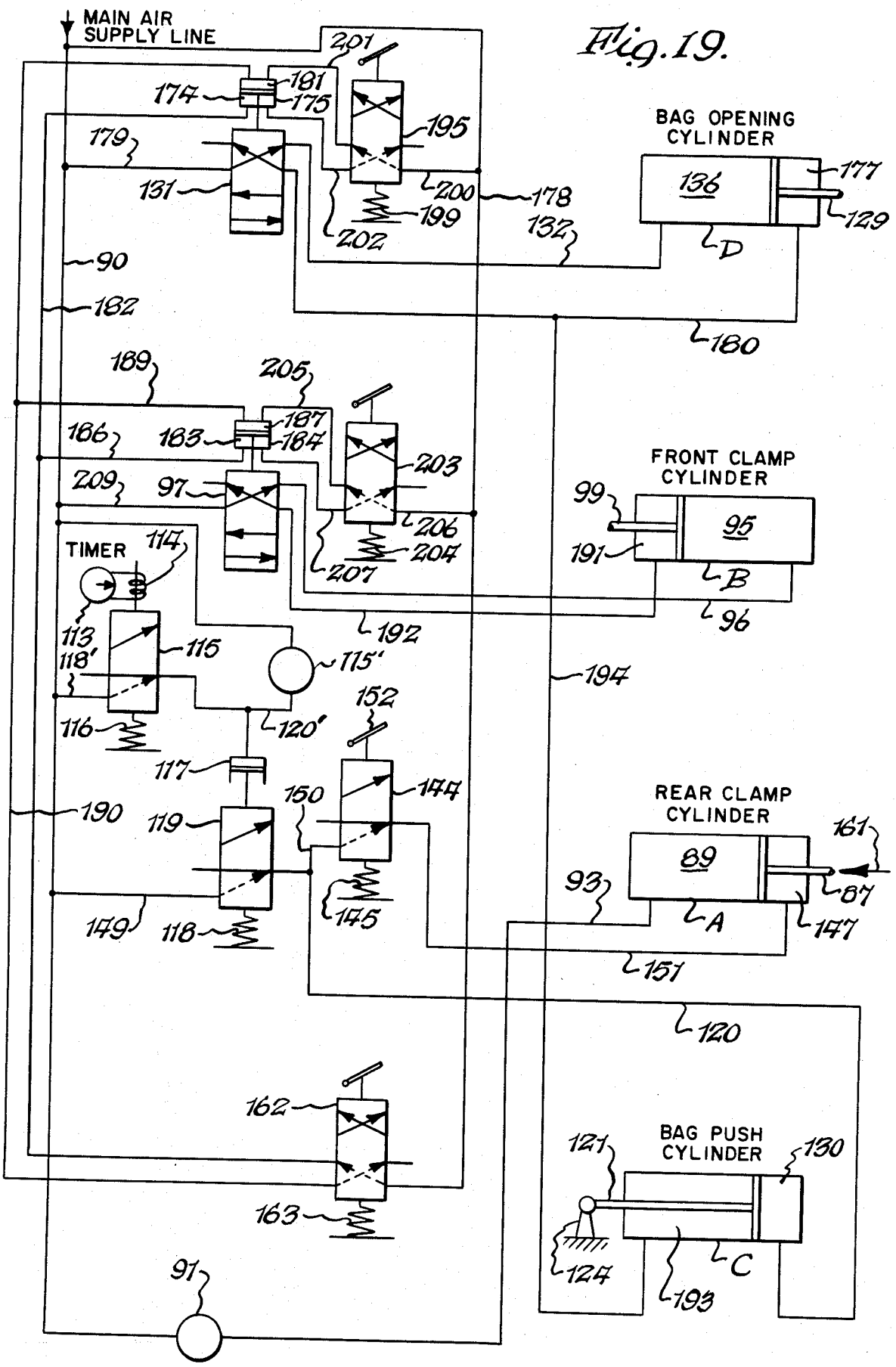
FIG. 19 is a schematic diagram of the pneumatic control circuit for the machine.

The various critical parts of the pneumatic circuit are shown schematically in FIG. 19. The various cylinders, pneumatic switches and valves are shown in FIG. 14 in the positions which they occupy when the bag is being held open during a filling operation. FIGS. 15–18 show the positions of the various parts of the circuit during other portions of the bag-handling cycle.

In FIG. 14 the piston 87 of rear clamp cylinder A (FIGS. 1, 14 and 19) is held fully to the right because chamber 89 of cylinder A (FIG. 19) is in direct communication with main air supply line 90 through pressure reducer 91. Thus the pressure in chamber 89 is less than in main line 90. The end of piston 87 is coupled to pressure plate 92 (FIGS. 1, 8, 9 and 14) which bears against the rearmost tab 76 of ream 62, the front tab 76 of ream 62 bearing against wicket bar 63. Thus the tabs 76 of ream 62 are pressed between plate 92 and wicket bar 63.

Rear clamp cylinder A is mounted on the bagger 10 in the following manner. A tubular member 165 (FIG. 1) is secured to upper leg portion 21 (FIGS. 1 and 1E). Angle bracket 167 is secured to member 165 by screws 169. A pin 170 extends outwardly from leg 171 of bracket 167, and ear 172 at the end of cylinder A is pivotally mounted on pin 170.

Figure 4A:
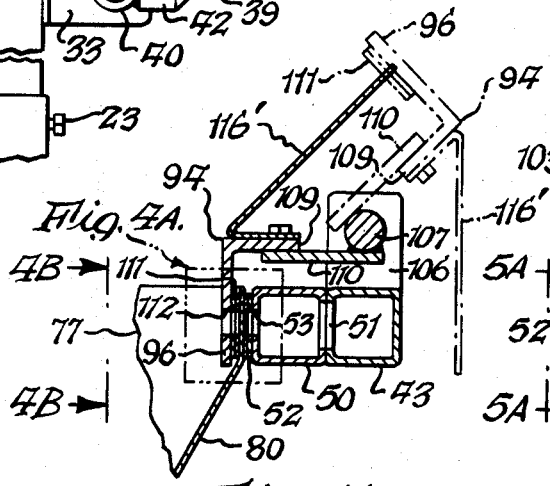
FIG. 4A is a fragmentary enlarged cross sectional view of the portion of FIG. 4 designated as FIG. 4A.
Figure 4:
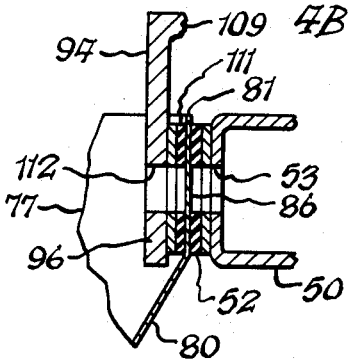
FIG. 4 is a fragmentary cross sectional view taken substantially along line 4—4 of FIG. 3 and showing the bag opening clamp in its solid line bag clamping position and in its dotted line open position.
Figure 5:
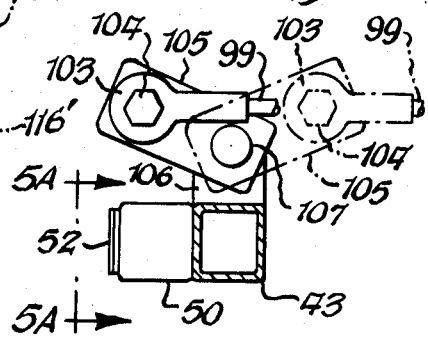
FIG. 5 is a fragmentary cross sectional view taken substantially along line 5—5 of FIG. 3 and showing the bag clamp actuating arm having one end mounted on the end of the front clamp cylinder piston rod and the other end mounted on the pivot shaft which mounts the bag opening clamp.
Figure 7:
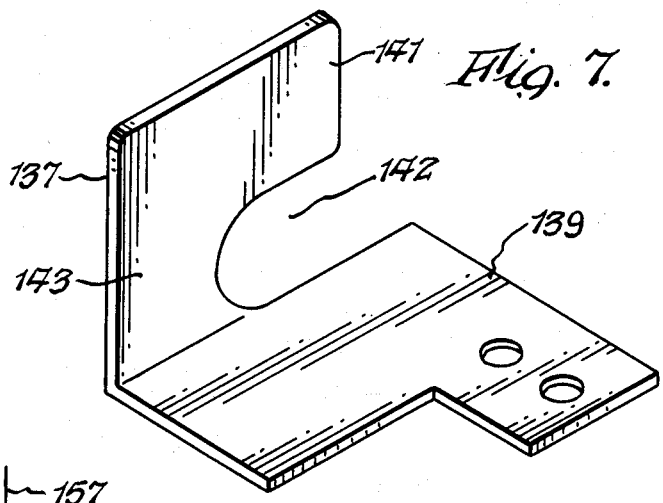
FIG. 7 is an enlarged fragmentary perspective view of the switch actuating plate which is mounted on the bag opening carriage.

When the parts are in the position of FIG. 14, the front upper edge portion 86 of front side 80 of bag 77 is clamped by clamp member 94 (FIGS. 4, 4A and 4B) because front clamp cylinder B (FIGS. 1, 14 and 19) has chamber 95 thereof in communication with main air supply line 90 through conduit 96, valve 97 and conduit 209 and chamber 191 of cylinder B is vented through conduit 192 and valve 97. The valve 97 is in the position shown in FIG. 19 at this time, to cause the piston rod 99 of front clamp cylinder B to be extended. The rear end 100 of front clamp cylinder B (FIGS. 1, 1C and 1D) is pivotally mounted on pin 101 which extends outwardly from bracket 102 which is welded to the side of tubular member 48. The outer end 103 of piston rod 99 is pivotally mounted on pin 104 (FIGS. 1, 5 and 5A) which extends outwardly from link 105 and has its opposite end fixedly secured to shaft 107. A ball joint 108 (FIG. 5A) couples the end 103 of piston rod 99 to pin 104 to allow for movements other than strictly linear. Shaft 107 is journalled in members 106 (FIGS. 3, 4B and 5A)

which extend upwardly from member 43. The reason valve 97 is in the solid line position in FIG. 19 is because switch 203 was previously placed in its dotted line position, as more fully described hereafter, to place chamber 187 of cylinder 184 in communication with main air pressure line 90 through conduit 178, switch 203 (in its dotted line position) and conduits 206 and 205. At the time chamber 187 was pressurized when switch 203 was in its dotted line position, chamber 183 of cylinder 184 was vented through conduit 207 and switch 203 (in its dotted line position). Switch 203 is the type which will always return to its solid line position under the bias of spring 204 when it is not actuated. Valve 97 is the type which will remain in the position in which it was last placed.

Clamp member 94 (FIG. 4) has a vertical leg 96 which clamps against the inner face of bag side 80, and it has a horizontal leg 109 which is bolted to plate 110 which is welded to shaft 107. Rubber-like strips 111 are mounted on vertical leg 96 and bear against the inner surface of front face 80 of the bag. A plurality of holes 112 (FIG. 4B), which are aligned with some of the holes 53 of suction head 50, extend through vertical leg 96 (FIGS. 4 and 4B). The bag 77 is held open with its front and rear sides clamped, as described above, for a period of time determined by the filling machine so that material, such as produce, can be dumped into its open mouth from the filling machine (not shown). A guide plate 116' is attached to clamp member 94 to guide material into open bag 77.

After the predetermined period of time has elapsed, timer 113 (FIG. 19) actuates solenoid 114 to move pneumatic switch 115 to its dotted line position against the bias of spring 116, to thus admit pressurized air to cylinder 117 through conduits 118' and 120'. Cylinder 117 moves valve 119 to its dotted line position against the bias of spring 118. This places chamber 130 of the bag push cylinder C (FIGS. 1, 2 and 19) in communication with main air supply line 90 through conduit 149, valve 119 and conduit 120. At this time chamber 193 of bag push cylinder C is vented through conduits 194 and 180 and valve 131. Piston rod 121 (FIGS. 1 and 11) of cylinder C is mounted by a ball joint connection 122, 129 on pin 123 which is mounted on the vertical leg 124 (FIGS. 1, 2 and 11) of bracket 126' which is mounted on cantilevered portion of member 24 and is secured thereon by a screw knob 128 which is threaded onto pin 138 attached to leg 124. The admission of pressurized air to cylinder chamber 130 (FIG. 19) moves cylinder C while piston 121 remains stationary because of the aforementioned fixed connection to tubular member 24. Thus, cylinder C will move from the position of FIG. 14 to the position of FIG. 15. The movement of bag push cylinder C to the right to the position of FIG. 15 will cause an accompanying movement of bag opening cylinder D to the right because of the pinned connection effected by bolt 126 (FIG. 2A) through ear-like bosses 125 and 127 of cylinders C and D, respectively, (FIGS. 1, 2, 2A and 2B). The bolt 126 holds cylinders C and D in rigid relationship relative to each other. The point to which the front 80 of bag 77 is moved can be adjusted by moving bracket 126 back and forth along tubular member 24 and tightening it in its adjusted position by tightening knob 128 onto shaft 138 to thereby force bracket leg 138' into clamping relationship with member 24 (FIG. 11).

At the time bag opening cylinder D is moved to the right by bag push cylinder C, the piston rod 129 of bag opening cylinder D is extended because compressed air is being supplied to chamber 136 thereof from main air supply line 90 through conduit 179, valve 131 and conduit 132 (FIG. 19). At this time chamber 177 of cylinder D is vented through conduit 180 and valve 131. As noted above, chamber 193 of bag push cylinder C is also vented through valve 131 through conduits 194 and 180. The reason that valve 131 is in its position of FIG. 19 is because previously pneumatic switch 195 was moved to its dotted line position against the bias of spring 199 to place chamber 181 of cylinder 175 in communication with main air supply line 90 through conduit 178, conduit 200, switch 195 and conduit 201, while chamber 174 was vented through conduit 202 and switch 195. A fitting 133 (FIGS. 1, 2, 2C and 2D) is mounted at the outer end of piston rod 129, and it is part of a ball joint which includes a ball 134 mounted on bar 135 which has its lower end welded to tubular member 48. As noted above, tubular member 48 is rigidly connected to carriage 39 and thus carriage 39 will be moved to the right along rods 34 and 35 as bag push cylinder C is moved to the right in FIG. 1.

Figure 6:
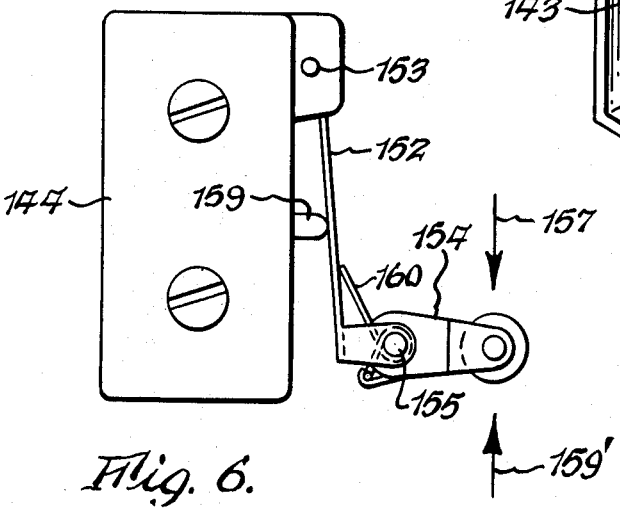
FIG. 6 is an enlarged plan view showing one of the pneumatic switches which is actuated by the switch plate.

A switch actuating plate 137 (FIGS. 3, 3A, 7 and 14) is mounted on carriage 39 and it includes a horizontal leg 139 which is bolted by bolts 140 to tubular member 43, which is connected to tubular member 48. Switch actuating plate 137 actuates switches 195, 203, 144 and 162 (FIGS. 1 and 19) as the carriage 39 moves along guide rods 34 and 35. Plate 137 includes an upper vertical portion 141 which is located above cutout 142 with upper vertical portion 141 being connected to plate 139 by lower plate portion 143. As the carriage 39 moves to the right, it will move tubular member 43 and the clamped front side 80 of bag 77 with it, and switch actuating plate 137 will also move to the right until it actuates pneumatic switch 144 (FIG. 15) which will move to its dotted line position (FIG. 19) against the bias of spring 145. At this time switch 119 is also in its dotted line position because timer 113 is holding switch 115 in its dotted line position, and thus communication is established between main air supply line 90 and chamber 147 of rear clamp cylinder A through conduit 149, valve 119, conduit 150, switch 144 and conduit 151. Switch 144 is actuated only momentarily for the length of time that it takes the upper portion 141 of switch plate 137 to wipe across it. In this respect, switch 144 (FIG. 6) includes a switch arm 152 which is pivoted at 153 and a finger 154 which is pivoted to arm 152 at 155. When the switch plate 137 is moving in the direction of arrow 157, it will wipe across finger 154 and force switch arm 152 in a clockwise direction about pivot 153 (FIG. 6) so that it depresses button 159 which opens the switch against the bias of spring 145 (FIG. 19). As soon as switch plate portion 141 loses contact with finger 154, spring 145 will close switch 144, that is, it will move it back to its solid line position. The momentary application of main air supply pressure, which is at 70 pounds per square inch, to chamber 147 of rear clamp cylinder A will override the 20 pound per square inch pressure which is applied to chamber 89 of rear clamp cylinder through pressure reducer 91, and thus there will be a momentary movement of piston rod 87 in the direction of arrow 161 (FIGS. 9 and 15) which in turn will move clamp plate 92 in the direction of arrow 161. This will relieve the pressure on the tab 76 of the bag which is being pulled to the right, and the portions 84 (FIG. 13) above holes 75 in tab 76 will be ripped so that the rear side 79 of bag 77 will be released from the wicket bar 63. Immediately after the release of tab 76, switch 144 returns to its solid line position wherein chamber 147 rear clamp cylinder A is vented through conduit 151 and switch 144. The full bag will then be supported only at its front side 80 by clamp 94 and, while so supported, it will drop downwardly until it rests on the upper run 156 of conveyor 158 (FIGS. 1 and 2) which is traveling in the direction of arrow 148. The lowermost portion of bag 77 does not engage moving conveyor 158 until after tab 76 is released from prongs 74. Conveyor 158 is tilted upwardly to the right (FIG. 2) and thus it will carry more of the load of the filled bag 77 as the latter moves to the right under the action of the bag push cylinder C, thereby relieving the strain on the front side 80 of bag 77.

At this point it is to be noted that switch 144 is actuated only when switch plate 137 is moving in the direction of arrow 157. However, when it is moving in the opposite direction 159', finger 154 will pivot in a counterclockwise direction about pin 155 against the bias of spring 160 and arm 152 will not pivot in a clockwise direction and thus plunger 159 will not be moved and thus switch 144 will remain in its dotted line position. In other words, switch 144 is actuated only when switch plate 137 is moving to the right in FIG. 1.

Continued movement of switch plate 137 to the right after it loses contact with switch 144 will result in actuation of switch 162 (FIG. 16) to its dotted line position (FIG. 19) against the bias of spring 163. Switch 162 is of the same construction as switch 144 shown in FIG. 6 so that it will actuated when switch plate 137 is moving to the right but not when it is moving to the left. The actuation of switch 162 will result in a plurality of actions. First of all, there will be communication between main air supply line 90 and chamber 174 of cylinder 175 through conduit 178, switch 162, and conduit 182. At this time chamber 181 of switch 175 will be vented through conduit 190 and switch 162. Cylinder 175 controls the position of valve 131, and when chamber 174 is pressurized, valve 131 will move upwardly so that there will be communication established between main air supply line 90 and chamber 177 of bag opening cylinder D through conduit 179, valve 131, and conduit 180. This will result in the movement of piston rod 129 of cylinder D to the left (FIGS. 1, 2, 16, 17 and 19). Movement of piston 129 to the left is possible because chamber 136 is now vented through conduit 132 and valve 131. Valve 131 is of the type which will remain in the position in which it was last placed. The same is true of valve 97.

While switch 162 is actuated (FIG. 16), the front clamp cylinder B is also actuated by the placing of the main air supply line 90 in communication with chamber 183 of cylinder 184 through conduit 178, switch 162 in its dotted line position, conduit 182, and conduit 186. At this time chamber 187 of cylinder 184 is vented through conduit 189, conduit 190, and switch 162 in its dotted line position. This will result in valve 97 moving upwardly to place main air supply conduit 90 in communication with chamber 191 of front clamp cylinder B through conduit 209, valve 97 and conduit 192, while chamber 95 is vented through conduit 96 and valve 97. This will cause piston rod 99 to move to the right in FIG. 19 and thus pivot link 105 (FIG. 5) to its dotted line position to thereby move clamp member 94 to its dotted line position in FIG. 4 to release the front upper edge of the bag. The weight of the filled bag will be sufficient to pull its front side away from suction head 50.

Also while switch 162 is being actuated (FIG. 16) to its dotted line position (FIG. 19), bag push cylinder is also moved to the left from the position shown in FIG. 16 to the position shown in FIG. 17 because main air conduit 90 is placed in communication with chamber 193 of bag push cylinder C through conduit 194 which is in communication with conduit 180 which is now in communication with main air supply conduit 90 through switch 131. At this time chamber 130 of bag push cylinder C is vented through conduit 120 and valve 119 in its solid line position. Valve 119 returned to its solid line position under the bias of spring 118 because cylinder 117 was vented through conduit 120' and switch 115 was returned to its solid line position under the bias of spring 116 after timer 113 timed out.

The movement of piston rod 129 of bag opening cylinder D to the left from FIG. 16 to the position of FIG. 17 and the movement of cylinder C to the left from the position shown in FIG. 16 to the position shown in FIG. 17 will result in the movement of carriage 39 to the left on its guide rods 34 and 35 until such time as switch plate 137 actuates switch 195 (FIG. 17). Switches 162, 144 and 203 cannot be actuated when switch plate 137 is moving to the left because they are of the construction described above relative to switch 144 of FIG. 6. However, immediately after switch plate 137 loses contact with switch 162, the latter will return to its solid line position under the bias of spring 163. Thus valve-actuating cylinders 175 and 184 will remain in the positions in which they were last placed until they are again actuated. As can be seen from FIG. 2, switch 195 is placed below switch 203 and thus switch 195 will be actuated by portion 143 (FIG. 7) of switch plate 137. It is also to be noted that switch 195 works in an exactly opposite manner than switch 144, namely, it is actuated when switch plate 137 is moving to the left in FIGS. 1 and 2 but it will not be actuated when it is moving to the right. In other words, it is mounted in a reverse manner to the switch 144 of FIG. 6. Furthermore, upper portion 141 of switch plate 137, while moving to the left, will wipe across switch 203 without actuating it because it operates in the same manner as switch 144 of FIG. 6.

When the carriage 39 reaches its limit of travel to the left in FIG. 1, the parts will be in the position shown in FIG. 17 wherein suction head 50 will be in abutting relationship with front side 80 of bag 77, and the suction will attract front side of bag 77 to it. Immediately after contact of suction head 50 with bag 80, switch 195 will be actuated to move to its dotted line position (FIG. 19). This will cause main air supply line 90 to be placed in communication with chamber 181 of cylinder 175 through conduit 178, conduit 200, switch 195, and conduit 201. At this time chamber 174 of cylinder 175 will be vented through conduit 202 and switch 195. Thus valve 131 will be moved back to the position shown in FIG. 19 so that chamber 136 of bag opening cylinder D is placed in communication with the main air supply line 90 through conduit 179, valve 131 and conduit 132, while chamber 177 of cylinder D is vented through conduit 180 and valve 131. This will cause piston rod 129 to move to the right and thus move the front side 80 of bag 77 away from the rear side 79 thereof to cause it to assume the open position shown in FIG. 14. The foregoing occurs when piston rod 129 moves from the position of FIG. 17 through the position of FIG. 18 to the position of FIG. 14.

The movement of piston rod 129 to the right from the position of FIG. 17 to the position of FIG. 18 will result in a corresponding movement of switch plate 137 and this will result in the actuation of switch 203 (FIG. 18) to move it to its dotted line position of FIG. 19 against the bias of spring 204. This will result in the placing of chamber 187 of cylinder 184 in communication with main air supply line 90 through conduit 178, conduit 206, switch 203 and conduit 205, while chamber 183 is vented through conduit 207 and switch 203. This will result in moving valve 97 back to the position shown in FIG. 19 wherein chamber 95 of front clamp cylinder B is placed in communication with the main air supply line 90 through conduit 209, valve 97 and conduit 96, while chamber 191 of cylinder B is vented through conduit 192 and valve 97. This will cause piston rod 99 to move to the left in FIGS. 18 and 19 which in turn will pivot shaft 107 (FIG. 5) to move clamp member 94 from its dotted line position to its solid line position in FIG. 4 to thereby clamp the top edge portion 86 of the bag front side 80.

The carriage 39 will continue to move after it loses contact with switch 203 until piston rod 129 reaches its limit of travel to the right whereupon the carriage 39 will stop with switch plate 37 in an intermediate position between switches 203 and 144 (FIG. 14). At this time, in response to other controls, not shown, the filling machine will release a load of material into the bag which is maintained in an open position as shown in FIG. 14. The carriage will remain stationary while the bag is being filled, and timer 113 will be actuated at the end of the filling cycle by suitable structure of the filling machine. Thereafter the timer 113 will actuate switch 115 to its dotted line position to pressurize cylinder 117 through conduits 118' and 120' to actuate valve 119 to its dotted line position (FIG. 19) which will energize the bag push cylinder C, by pressurizing chamber 130 from conduit 90 through conduit 149, valve 119 and conduit 120, while chamber 193 is vented through conduit 194, conduit 180 and valve 131 to thus move carriage 39 until switch plate 137 actuates switch 144, whereupon the above-described cycle is repeated. The timer 113 is actuated by the filling machine (not shown) after the last item leaves it, and the timer operates for a length of time necessary for the switch plate 137 to actuate switch 144. After it times out, switch 115 will return to the position shown in FIG. 19 under the bias of spring 116 and cylinder 117 will be vented through switch 115 so that valve 119 will return to its solid line position to vent chamber 130 of bag push cylinder C. By this time, the bag push cylinder has been fully extended.

Switches 195, 203, 144 and 162 are of the spring-biased type, that is they will always return to their solid line positions in FIG. 19 when they are not actually being actuated by switch plate 137. Switch 162 is adjustably mounted on rails 210 and 211 (FIGS. 1, 2, 1B, 1G and 1H) by screws 213, and switches 195 and 144 and are adjustably mounted in a like manner by screws, such as 213, which thread into the bodies of the switches with the heads of the screws bearing on the undersides of rails 210 and 211, which are mounted on the top of member 24 and are spaced therefrom. Switch 203 is mounted on the top of switch 195 (FIG. 2). There are spacers 214 (FIG. 2) between switch 144 and rails 210 and 211. Thus switches 144 and 203 are actuated by the top portion 141 of switch plate 137, and switches 195 and 162 are actuated by the lower portion 143 of switch plate 137. It is quite apparent that by adjusting the positions of switches 195, 144 and 162 along rails 210 and 211, the cylinders A, C and D can be actuated at any desired time, thereby determining when the bag is opened, when it is clamped, when its rear side is released, when it is moved to the right in FIG. 1, and when the machine is reversed, as discussed in detail above.

If for any reason carriage 39 does not move out of its position in FIG. 14, recycle switch 115' can be actuated manually to pressurize cylinder 117 from air supply line 90 to move valve 119 to its dotted line position to pressurize chamber 130 of bag push cylinder C to move carriage 39 until switch plate 137 hits switch 144 to thereby start the cycle from the position of FIG. 15.

While the foregoing description shows clamp leg 96 in direct opposition to suction head 50 when clamping the upper front edge 86 of the bag 77 therebetween, it will be appreciated that a clamping structure equivalent to clamp leg 96 may be used, and such equivalent structure may be a surface on one or both sides of suction head 50 and one or two clamping members similar to clamping leg 96 which bear against such surface or surfaces with the upper edge of the bag therebetween.

Furthermore, the amount bag 77 is opened is governed by the location of clamping bracket 126', as discussed above, in combination with the amount which piston rod 129 extends from cylinder D. In this respect, when suction head 50 abuts the outermost bag, if the piston rod is not fully within cylinder D, the bag will be opened only the distance piston rod 129 can travel from this position to its fully extended position. However, if piston rod 129 is fully within cylinder D when the suction head is against the bag at the wicket bar, as determined by the position of clamp 126', then the bag can be opened the full length of piston rod 129. In other words, greater bag opening is achieved by moving bracket 126' to the right in FIG. 1.

While a preferred embodiment of the present invention has been disclosed, it will be appreciated that it is not limited thereto but may be otherwise embodied within the scope of the following claims.

What is claimed is:

1. A bagger comprising a frame, a wicket bar having a front side and a rear side on said frame for mounting a ream of bags each having a front side and a rear side with said front sides of said bags facing said rear side of said wicket bar, said bags also having tabs at the upper ends of said rear sides, a rear clamp cylinder including a rear clamp piston rod, a rear clamp plate on said rear clamp piston rod for movement toward said wicket bar with said rear clamp piston rod to press against said tabs of said bags, a carriage, means mounting said carriage on said frame for movement toward and away from said wicket bar, a suction head on said carriage, means for creating a suction in said suction head, a bag opening cylinder mounted between said frame and said carriage for moving said carriage and said suction head thereon toward said ream on said wicket bar to engage the front side of the outermost bag on said ream and apply suction thereto and for moving said suction head away from said ream to pull the front side of said outermost bag away from the rear side thereof which is held on said wicket bar, a front clamp cylinder, means mounting said front clamp cylinder on said carriage, a front clamp piston rod on said front clamp cylinder, a clamp member on said carriage coupled to said front clamp piston rod, means mounting said clamp member for movement toward and away from said suction head to selectively clamp said upper edge portion of said front side of said bag after it has been moved away from said wicket bar and to selectively release said upper edge portion of said front side of said bag, and a bag push cylinder effectively mounted between said frame and said carriage for pushing said outermost bag away from said wicket bar while said front upper edge portion is effectively clamped between said suction head and said clamp member.

2. A bagger as set forth in claim 1 wherein said bag opening cylinder and said bag push cylinder are coupled in series.

3. A bagger as set forth in claim 1 including means for causing said rear clamp cylinder to move said rear clamp plate away from said rear face of said wicket bar while said push cylinder is moving said carriage with said front upper edge portion of said bag clamped away from said wicket bar to thereby release said rear side of said bag.

4. A bagger as set forth in claim 1 including a conveyor located below said bag for supporting said bag while said front upper edge portion is being held by said clamp member.

5. A bagger as set forth in claim 1 including first switch means, first valve means actuated by said first switch means to actuate said bag push cylinder to move said carriage away from said wicket bar and thus also move said front side of said bag away from said wicket bar while said front upper edge portion is effectively clamped between said suction head and said clamp member, second switch means actuated by said carriage for momentarily actuating said rear clamp cylinder to move said rear clamp plate away from said wicket bar to release said tab of said bag while said bag push cylinder is moving said carriage away from said wicket bar, third switch means actuated by said carriage, second valve means actuated by said third switch means to cause said bag front clamp cylinder to release said front upper edge portion of said bag and to cause said bag opening cylinder and said bag push cylinder to cause said carriage to move toward said wicket bar until said suction head engages the front side of an outermost bag, fourth switch means actuated by said carriage, third valve means actuated by said fourth switch means for causing said bag opening cylinder to pull said front side of said bag away from the rear side thereof while said front side has suction applied thereto by said suction head, fifth switch means actuated by said carriage, and fourth valve means actuated by said fifth switch means for causing said front clamp cylinder to move said clamp member into clamping engagement with said upper edge portion of said front side of said bag while said rear side of said bag is clamped by said rear clamp plate.

6. In a bagger, a bag opening and clamping mechanism for a bag having a front side with an upper edge portion and also having a rear side comprising a frame, means fixedly mounting said rear side of said bag on said frame, a carriage on said frame, suction means on said carriage, means for moving said carriage toward said front side to cause said suction means to engage said upper edge portion and for moving said carriage away from said rear side of pulling said upper edge portion away from said rear side, clamping surface means on said carriage adjacent said suction means, a clamp member, mounting means mounting said clamp member on said carriage, and motor means for selectively moving said clamp member toward said suction means and said clamping surface means to apply a clamping force to the inside of said upper edge portion in a direction toward said suction means and said clamping surface means after said front side has been pulled away from said rear side by said suction means to thereby clamp said upper edge portion to said clamping surface means with said suction means and said clamping surface means on the outside of said upper edge portion and said clamp member on the inside of said upper edge portion.

7. In a bagger, a bag opening and clamping mechanism as set forth in claim 6 including means for causing said clamp member and said clamping surface means to remain stationary to hold said first side stationary after said front side has been pulled away from said rear side, and means for thereafter moving said carriage with said front side clamped thereto further away from said rear side after said first side was held stationary and while said rear side remains fixedly mounted on said frame.

8. In a bagger, a bag clamping mechanism as set forth in claim 6 wherein said motor means comprises a piston and cylinder.

9. In a bagger, a bag clamping mechanism as set forth in claim 6 wherein said suction means and said clamping surface means are located on a suction head, and wherein said clamp member clamps said upper edge portion to said suction head.

10. A bagger comprising a frame, a wicket bar on said frame for mounting a bag having a front side and a rear side and a tab at the upper edge portion of the rear side of the bag with the front side of said bag being located below said wicket bar, first means including first control means and first clamp means for clamping said tab of said bag against said wicket bar, a carriage on said frame, a suction head on said carriage, second means including second control means for moving said carriage toward said wicket bar to cause said suction head to engage the upper edge portion of the front side of said bag and for moving said suction head away from said wicket bar to move said front side of said bag which is held against said suction head by suction away from the rear side of said bag which is clamped to said wicket bar to thereby open the mouth of said bag, second clamp means, means mounting said second clamp means on said carriage, third means including third control means for causing said second clamp means to apply a clamping force to said upper edge portion of each bag after said front side has moved away from said rear side and for causing said front side to thereafter remain stationary, and fourth means including fourth control means for moving said front side of said bag while still clamped by said second clamp means further away from said wicket bar.

11. A bagger as set forth in claim 10 including a conveyor located below said carriage for supporting the underside of said bag after it has been moved further away from said wicket bar by said fourth means.

12. A bagger as set forth in claim 10 wherein said second clamp means clamps said upper edge portion against said suction head.

13. A bagger as set forth in claim 10 including fifth means including fifth control means for momentarily moving said first clamp means away from said wicket bar to thereby release pressure on said tab while said front side is being moved in a direction further away from said wicket bar by said fourth means to thereby release said tab from said wicket bar.

14. A bagger as set forth in claim 13 including a conveyor located below said carriage for supporting the underside of said bag after its tab has been released from said wicket bar.

15. A bagger as set forth in claim 14 wherein said conveyor includes an upper run which is upwardly inclined in its direction of movement away from said wicket bar.

16. A bag mounting and releasing structure for a bagger comprising a frame, a wicket bar on said frame having a rear face and a front face for mounting a ream of bags each having a front side and a rear side and tab located at the upper edge portion of said rear side and holes in said tab, a plurality of prongs extending outwardly from said rear face of said wicket bar for insertion into holes in said tabs with said front sides of said bags facing said rear side of said wicket bar, first motor means, a clamp plate coupled to said first motor means, first control means coupled to said first motor means for causing said first motor means to cause said clamp plates to normally clamp said tabs of said ream of bags against said rear face of said wicket bar, a carriage mounted on said frame, means for moving said front side of said bag away from said rear side thereof to thereby open said bag, clamping means on said carriage for clamping said front side of said bag to said carriage after it has been moved away from the rear side thereof, second motor means, second control means for causing said second motor means to move said carriage away from said wicket bar after said bag has been opened and while said front side remains clamped to said carriage and while said tabs remain clamped to said wicket bar, and third control means coupled to said first motor means to selectively cause said first motor means to cause said clamp plate to momentarily move away from said rear face of said wicket bar to release pressure on said tabs and thereafter immediately cause said clamp plate to return to its normal clamping position as said second motor means is moving said carriage away from said wicket bar with said front side still clamped, said momentary releasing of said tab while said carriage with said first side of said bag clamped thereto is moving away from said wicket bar facilitating separation of said bag said wicket bar.

17. A bag mounting and releasing structure as set forth in claim 16 including third motor means operatively coupled to said clamping means on said carriage, fourth control means for causing said third motor means to cause said clamping means to release said front side of said bag after said rear side has been separated from said wicket bar, and wherein said means for moving said front side of said bag away from said rear side thereof comprise suction means on said carriage, and fifth control means for causing said second motor means to move said carriage toward said ream of bags to cause said suction means to engage the front side of an outermost bag, and sixth control means for causing said second motor means to move said carriage away from said ream to move said front side of said bag away from the rear side thereof immediately after said front side has been engaged by said suction means.

18. A bag mounting and releasing structure as set forth in claim 17 wherein said second motor means comprise a first fluid motor for causing said carriage to move said front side of said bag away from the rear side thereof immediately after said suction means has engaged said front side of said bag, and a second fluid motor for moving said carriage away from said wicket bar after said bag has been opened while said tab is being momentarily released.

19. A bag mounting and releasing structure for a bagger as set forth in claim 16 wherein said first and second motor means each comprise a piston and cylinder.

20. A bag mounting and releasing structure as set forth in claim 16 including conveyor means located below said bag for supporting said bag while said front side is being clamped to said carriage after said rear side has been released from said wicket bar.

21. A bag mounting and releasing structure as set forth in claim 20 including third motor means operatively coupled to said clamping means on said carriage, and third control means for causing said third motor means to cause said clamping means to release said front side of said bag after said tab on said rear side has been separated from said wicket bar and while said bag is being supported on said conveyor means.

22. A bag mounting and releasing structure as set forth in claim 21 wherein said first, second, and third motor means each comprise a piston and cylinder.

23. A bag opening and moving structure for a bagger comprising a frame, a wicket bar on said frame for mounting the rear sides of a ream of bags also having front sides, a suction head, first cylinder means mounted on said frame for moving said suction head into engagement with the front side of the outermost bag on said ream and thereafter moving said suction head away from said ream to move said front side of said bag away from the rear side thereof to thereby open said outermost bag, and second cylinder means mounted on said frame for moving said front side of said bag further away from the rear side thereof.

24. A bag opening and moving structure for a bagger as set forth in claim 23 including clamp means mounted relative to said suction head for clamping the upper edge portion of said front of said bag after it has moved away from the rear side thereof.

25. A bag opening and moving structure for a bagger as set forth in claim 23 wherein said first and second cylinder means comprise two cylinders mounted in end-to-end relationship.

* * * * *

UNITED STATES PATENT AND TRADEMARK OFFICE

CERTIFICATE OF CORRECTION

PATENT NO. : 4,715,167

DATED : December 29, 1987

INVENTOR(S) : James G. Savigny

It is certified that error appears in the above-identified patent and that said Letters Patent is hereby corrected as shown below:

Column 13, line 63 (claim 6), change "of" to --for--.

Column 15, line 10 (claim 16), before "tab" insert --a--.

Column 15, line 42 (claim 16), before "said" insert --from--.

Signed and Sealed this

Tenth Day of May, 1988

*Attest:*

*Attesting Officer*

DONALD J. QUIGG

*Commissioner of Patents and Trademarks*